US005924823A

United States Patent [19]

Palffy

[11] Patent Number: 5,924,823

[45] Date of Patent: Jul. 20, 1999

[54] SUCTION NOZZLE, METHOD FOR OPERATION, AND USE OF THE NOZZLE

[75] Inventor: Sandor Palffy, Ennetbaden, Switzerland

[73] Assignee: Festo KG, Esslingen, Germany

[21] Appl. No.: 08/765,211

[22] PCT Filed: Jul. 4, 1995

[86] PCT No.: PCT/CH95/00153

§ 371 Date: Jan. 6, 1997

§ 102(e) Date: Jan. 6, 1997

[87] PCT Pub. No.: WO96/01071

PCT Pub. Date: Jan. 18, 1996

[30] Foreign Application Priority Data

Jul. 5, 1994 [CH] Switzerland ..... 2165/94

[51] Int. Cl.[6] ..... B65G 51/22

[52] U.S. Cl. ..... 406/152; 406/92; 15/420

[58] Field of Search ..... 15/420, 421; 406/92, 406/151, 152, 153, 194

[56] References Cited

U.S. PATENT DOCUMENTS 2,027,543 1/1936 Lofgren ..... 15/420

3,238,557 3/1966 Foster ..... 15/421 X

*Primary Examiner*—William E. Terrell

*Assistant Examiner*—Gene O Crawford

*Attorney, Agent, or Firm*—Schweitzer Cornman Gross & Bondell LLP

[57] ABSTRACT

A suction nozzle, comprises a suction nozzle tube having a first end for connection to a suction line and a second end forming a suction port, and at least one lateral opening in the suction nozzle tube in a zone of the suction port for a further flow extending in a direction tangential to the suction flow wherein the at least one lateral opening is formed by at least one bent wing raised from the suction-nozzle tube. The suction nozzle may be surrounded by outer guide walls forming a box in which a pressure nozzle is directed into the suction port. The pressure nozzle flow may be used to generate a shearing force flow superimposed upon a vortex flow generated within the suction nozzle.

8 Claims, 7 Drawing Sheets

SUCTION NOZZLE, METHOD FOR OPERATION, AND USE OF THE NOZZLE

BACKGROUND OF THE INVENTION

Known nozzles work more or less perpendicularly to a surface and if not guided along that surface, tend to stick to it, i.e., the suction port draws itself onto the surface being worked and prevents the removal of the particles and/or the flow medium.

At the same time, such nozzles require relatively large amounts of energy, as they must lift up the particles and/or the flow medium adhering to the surface against the effect of gravity and/or surface adhesion.

A vacuum-cleaner nozzle is known from FR-A-779498. This nozzle has a relatively wide base surface crossed by grooves linearly leading from the periphery of the nozzle body tangentially into the bore of the suction tube, which results in a circular flow in the tube.

This vacuum cleaner nozzle demands a good ground contact in the region of the suction tube. If this is not provided, no circular flow results. The long grooves required are disadvantageous from the energy point of view and impair the suction effect of the nozzle.

It is thus an object of the present invention to provide a nozzle which is free of the disadvantages of the prior art, requires little energy for sucking up the particles and/or flow media and ensures their removal without elevated flow velocities. In particular, this nozzle during operation should produce little noise and should not tend to clog the suction port.

In addition, this nozzle should generate a flow that is beneficial for such applications as heat exchangers, flues, and material separators.

BRIEF DESCRIPTION OF THE INVENTION

The advantage of the invention resides in the fact that, due to the design described, a vortex is created in a suction nozzle whereby a shearing force is formed in and below the suction port, which detaches, and sets into motion, the solid particles and/or flow media to be removed.

Equally beneficial for the improvement of heat transfer in heat exchangers, flues, heating plants, etc., are the longitudinal vortices produced by the nozzle, which eliminate the entrance cavitation created in every fluid flow.

Advantageously, the nozzle is of a tubular-form. However, if required by structural configurations, the nozzle can also have the form of a channel.

An adaptive control of the vortex formation can be effected by the supply of extraneous energy, bypasses, etc. Use of a concentric collar permits the beneficial suction effect to be extended beyond the suction port.

The invention can in practice be used for cleaning devices of almost any type, especially street sweeping machines etc. A pressure-nozzle component, provided in addition to a suction-nozzle tube acts, due to the resulting shearing force, from the marginal regions towards the central suction port, enhancing vortex formation.

A sharp edge may be provided in the suction port for facilitating detachment of the boundary layer flow within the operating region of the nozzle.

A method for operating the apparatus produces in a simple manner a counter-rotating, spiral-shaped vortex formation which, also within the suction-nozzle tube, serves to draw in the medium.

In order to attain the shearing force desired in the operating region, the pressure relations may be superposed and adjusted. Adjusting the relations can be carried out empirically by altering the geometric relations or by a suitable proportioning of the partial flows.

Uses may utilize the axis-parallel vortex formation achieved with the aid of the nozzle and thus permit the elimination of some well-known problems.

BRIEF DESCRIPTION OF THE DRAWINGS

With the aid of several drawings, the invention will be explained in greater detail. Identical components are given identical reference numerals. Components not essential for an understanding of the invention are left out for the sake of clarity.

In the drawings.

DETAILED DESCRIPTION OF THE INVENTION

Figure 1:
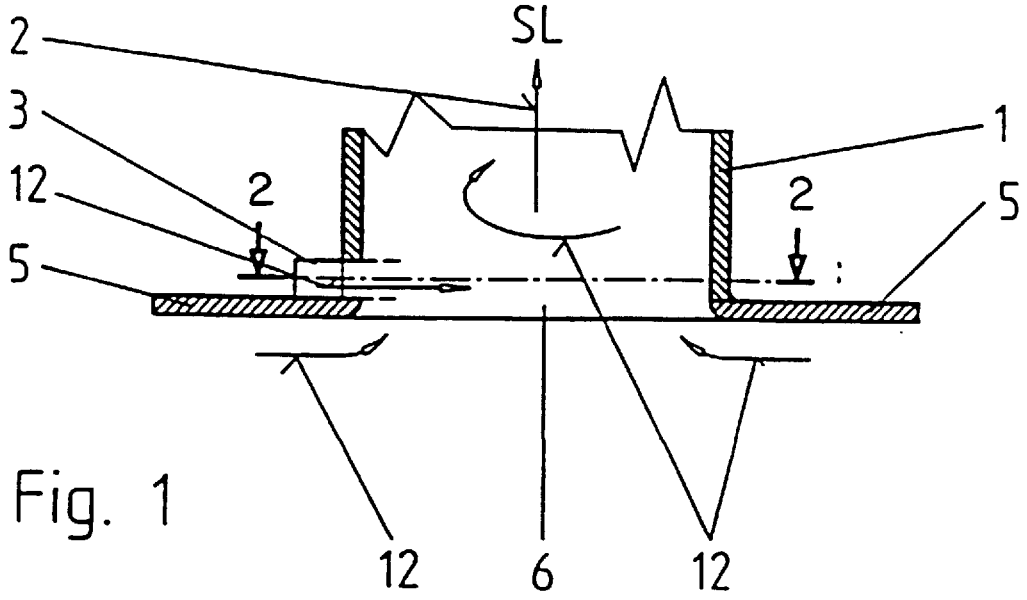
FIG. 1 is an axial cross-sectional view of a first embodiment of the nozzle according to the invention with an outwardly bent wing and a collar.

In FIG. 1 a suction-nozzle tube in a vertical cross section is designated with numeral 1, the direction of suction 2 being indicated by a vertical arrow. Below, the suction-nozzle tube 1 is provided with an outwardly bent wing 3, its upper part being connected to a suction line SL. Surrounding the suction port 6 of the suction-nozzle tube 1 there is seen a concentric collar 5. The resulting flows are marked with straight or curved arrows 12.

Figure 2:
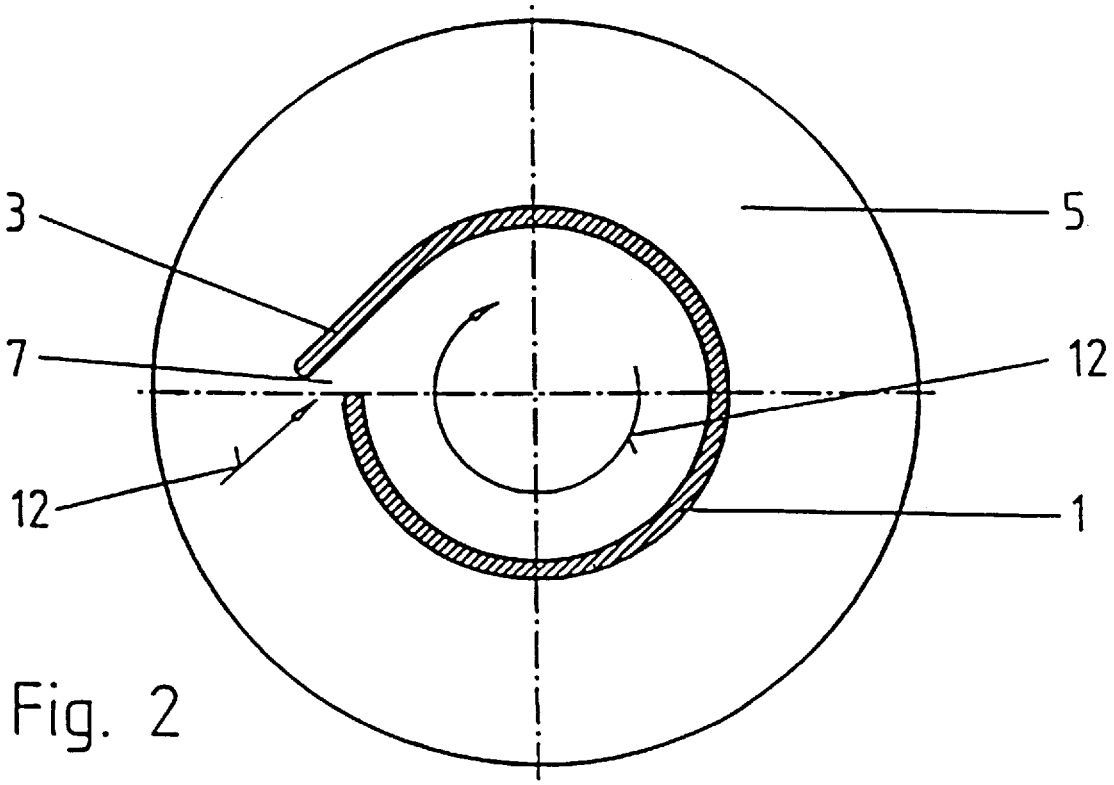
FIG. 2 is a cross-sectional view along plane 2—2 of FIG. 1.

In the top view of FIG. 2, corresponding to the cross-section 2—2 of FIG. 1, there can be seen, in addition to the above-described components, an opening 7 in the tube 1, produced by bending of the wing 3.

The subsequent FIGS. 3 to 10 represent variants of the object of FIGS. 1 and 2, with functionally equivalent components in all Figures being given identical reference numerals.

Figure 3:
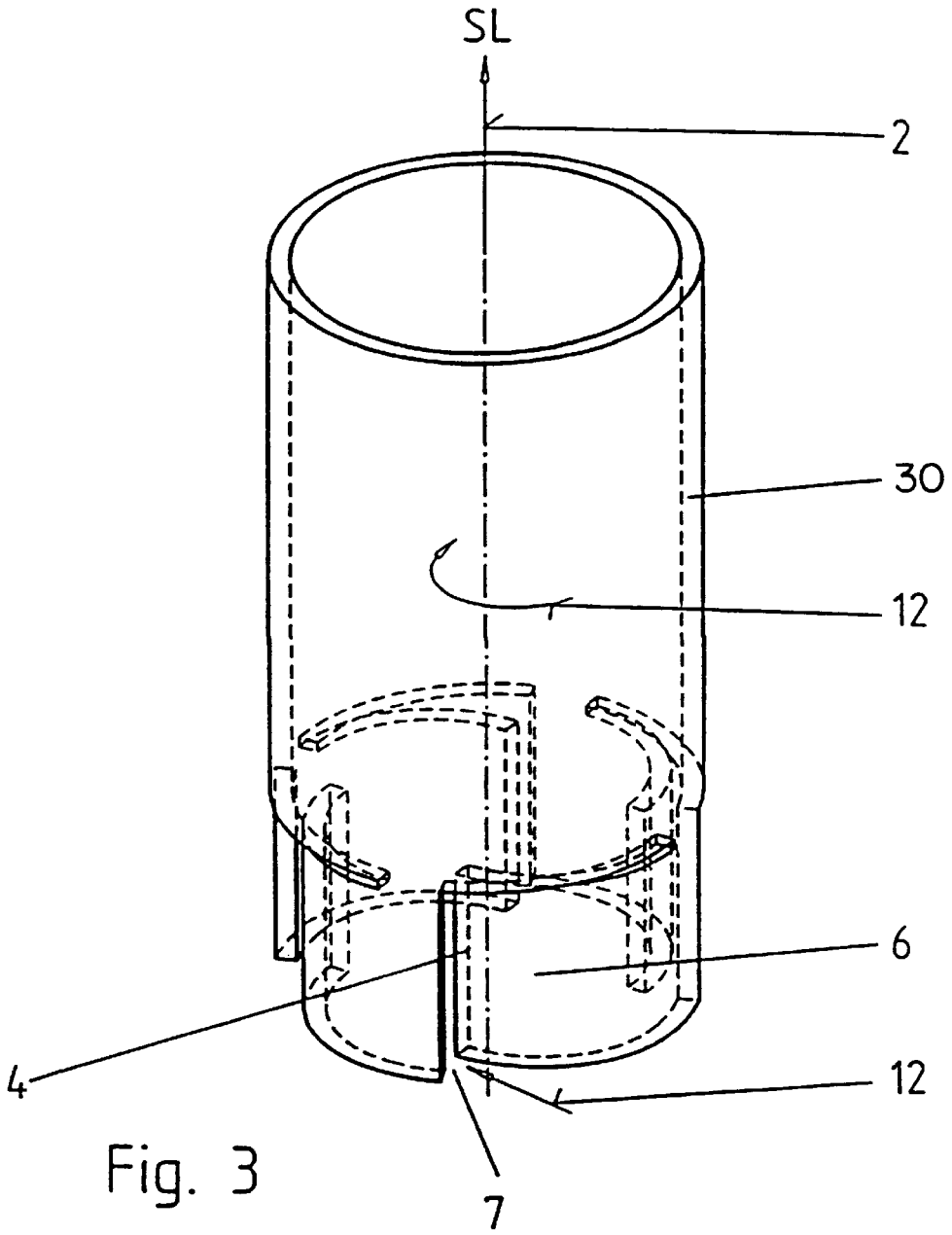
FIG. 3 represents another embodiment of the nozzle according to the invention in a perspective view, with four inwardly bent wings.

In FIG. 3, the suction nozzle tube 30, the wings 4 which act in analogy to FIGS. 1 and 2, are bent towards the interior of the tube. Here, too, the flow 12, acting through the opening 7 tangentially with respect to the suction direction 2, results in a circular flow and is marked by an appropriate, circular arrow.

Figure 4:
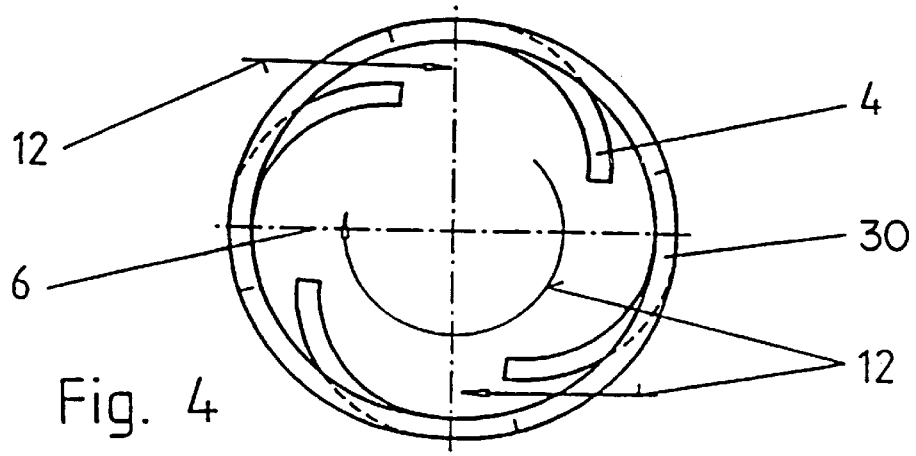
FIG. 4 is a top view of the invention according to FIG. 3.

The top view of nozzle tube 30 in FIG. 4 indicates the arcuate form of the wings 4, as well as the resulting circular flow in the clockwise sense.

Figure 5:
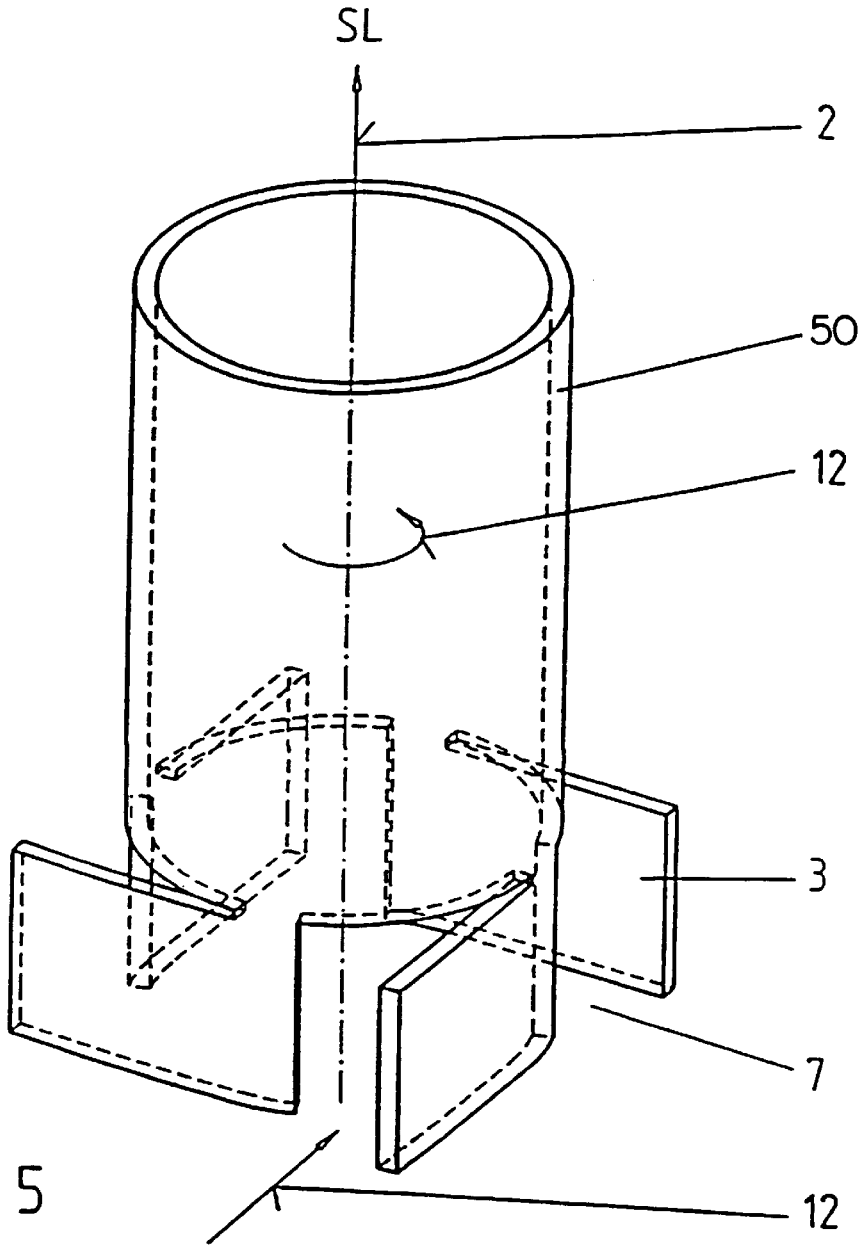
FIG. 5 illustrates an example of an embodiment of a nozzle with four outwardly bent wings.
Figure 6:
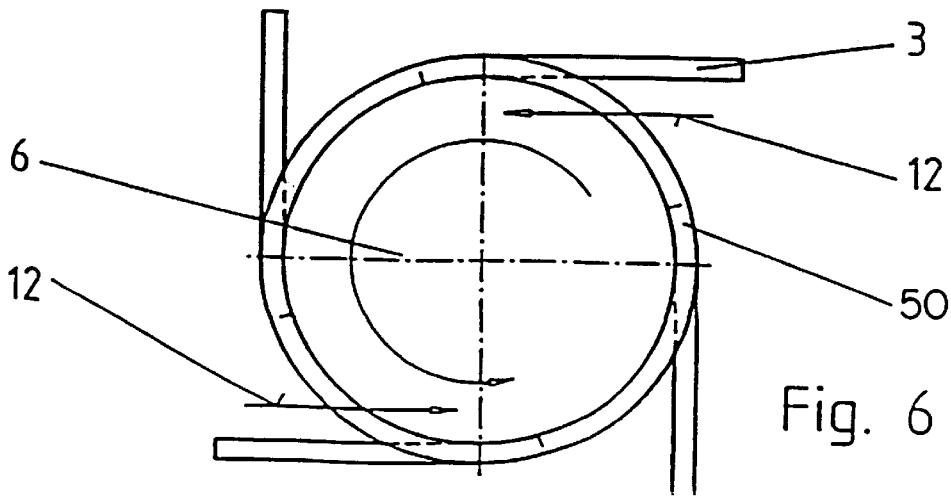
FIG. 6 is a top view of the invention according to FIG. 5.

The embodiment according to FIGS. 5 and 6 shows a nozzle tube 50 with again outwardly bent wings 3 which however, as against FIGS. 1 and 2, are planar, thus forming larger openings 7.

Figure 7:
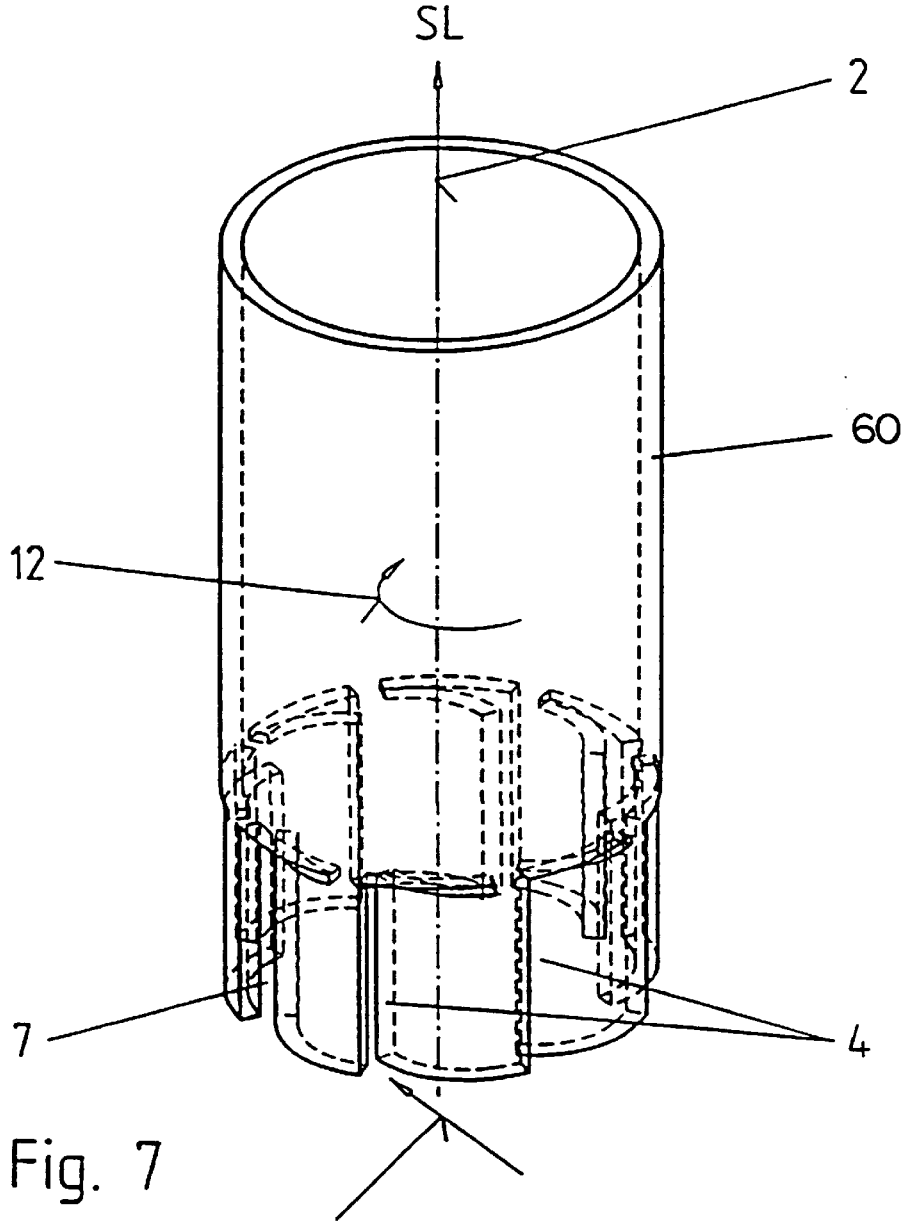
FIG. 7 shows a further embodiment of the nozzle with eight inwardly bent wings.
Figure 8:
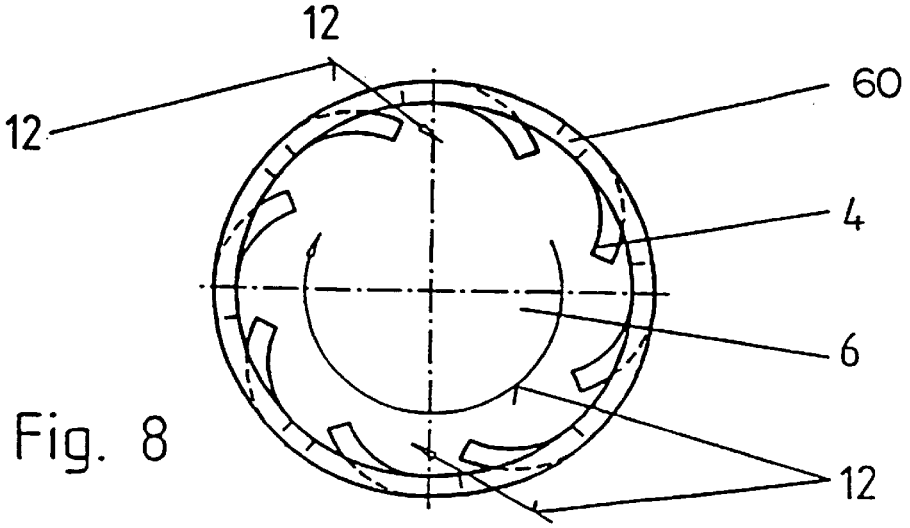
FIG. 8 is a top view of the invention according to FIG. 7.
Figure 9:
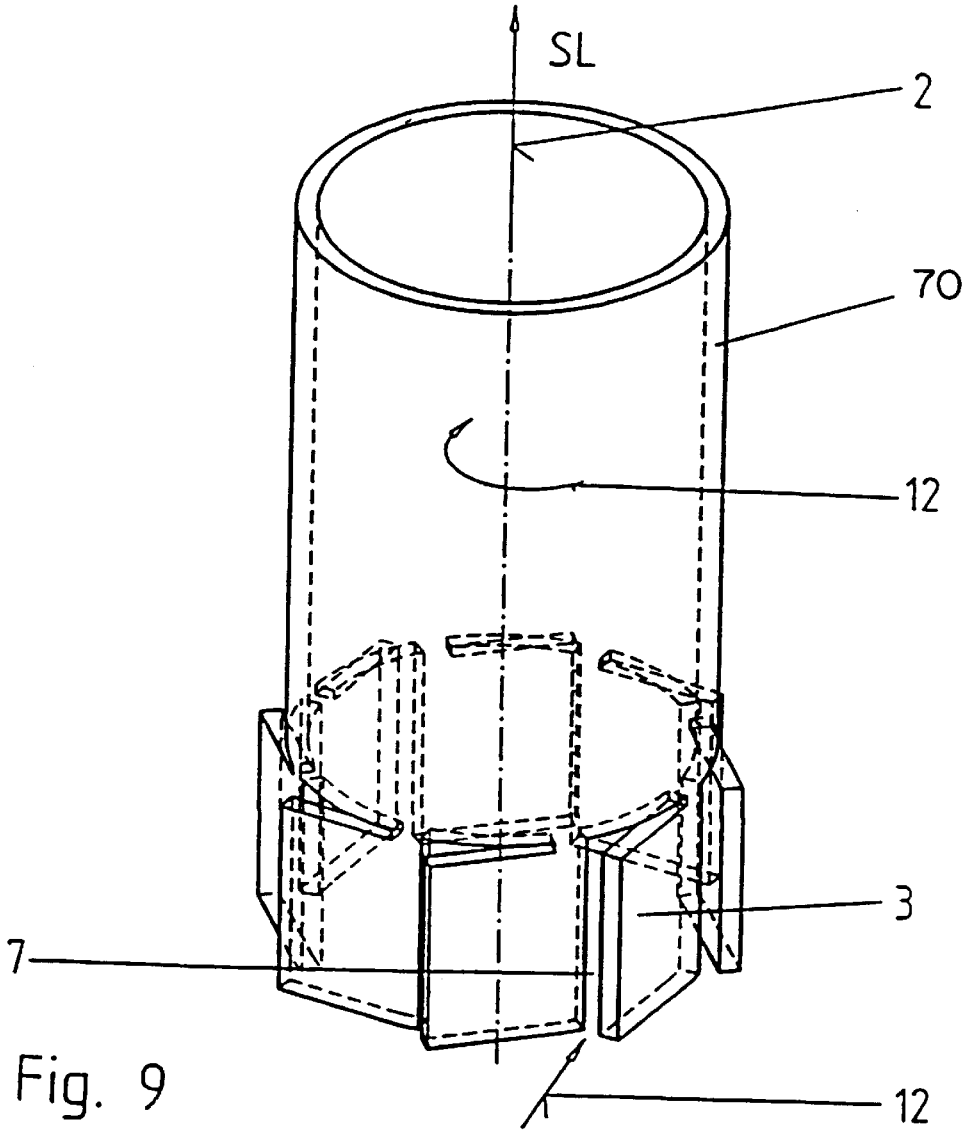
FIG. 9 is a perspective view of a nozzle with eight outwardly bent wings.
Figure 10:
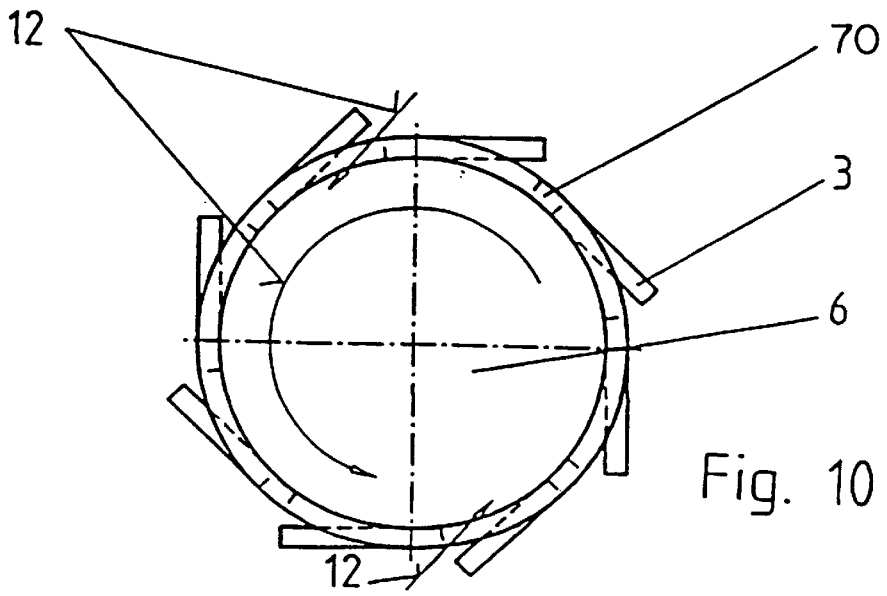
FIG. 10 is a top view of the invention according to FIG. 9.

While the embodiments of FIGS. 1 to 6 show only one or four wings 3 or 4, FIGS. 7 to 10, with nozzle tube 60 in FIGS. 7 and 8 and nozzle tube 70 in FIGS. 9 and 10, show each eight inwardly respectively outwardly bent wings.

Obviously, the number of wings 3 or 4, as well as the resulting openings 7, affect the tangential flow and thus the vortex formation in the suction tube.

Clearly, the suction tube according to the invention is suitable for every flowable medium and can therefore be connected to any suction device. A particular advantage resides in the fact that the vertical suction opening is practically uncloggable, as due to the vortex formation-acting spirally in direction of suction-solid particles, too, are detached from one another, with the suction effect being fully maintained. The same can be observed when the suction tube stands flatly on a plane surface: it can be lifted off the supporting surface without extreme use of force and/or can be shifted along that surface.

Figure 11:
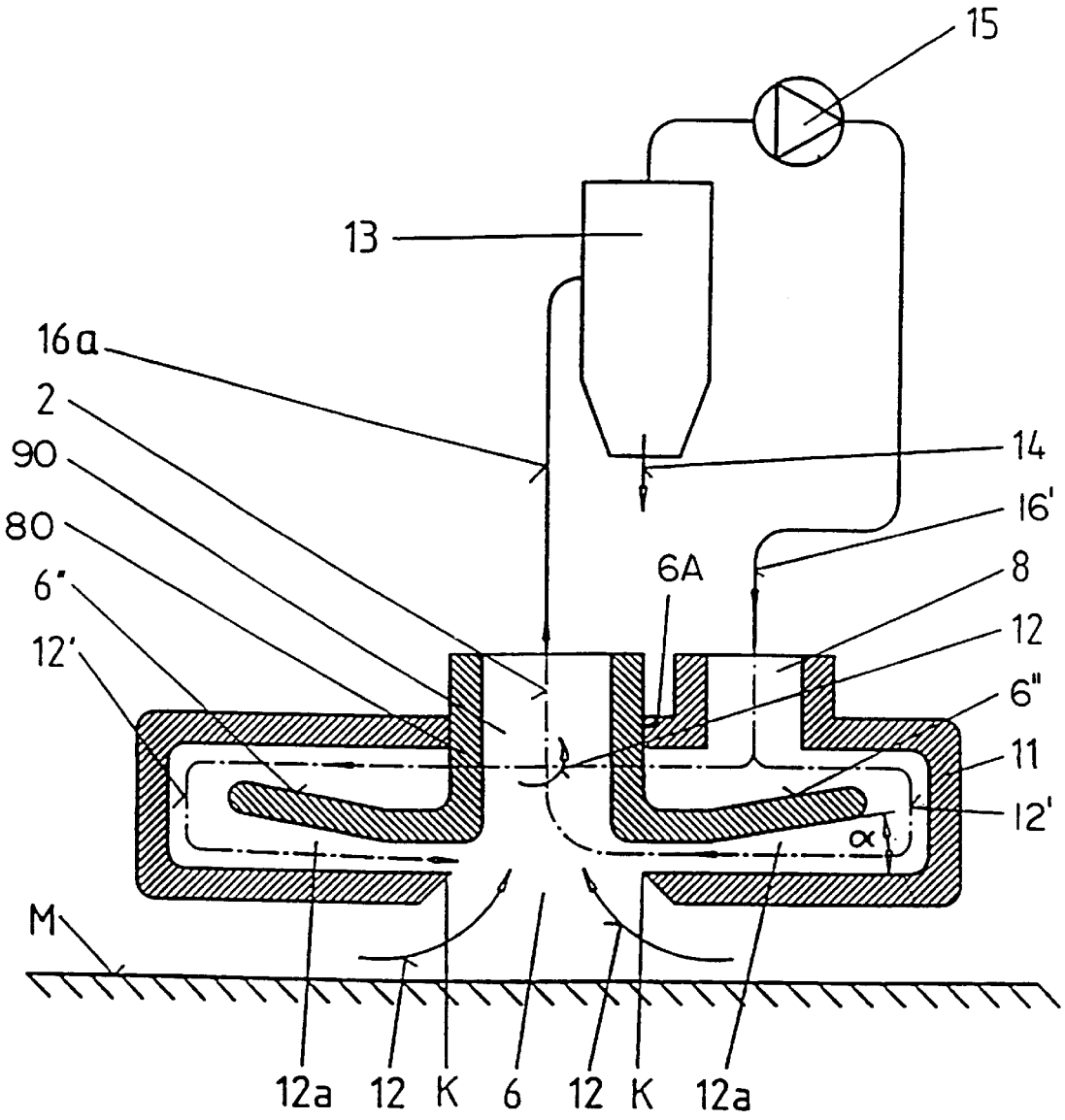
FIG. 11 represents an embodiment which, in addition to the suction nozzle tube, also uses a pressure-nozzle component in the form of two nozzles.

FIG. 11 illustrates a variant of a nozzle particularly suitable for the cleaning of sidewalks, streets and squares:

In addition to the suction-nozzle tube 80 in which is generated the already described vortex flow, there are provided in a box of outer guide walls 11 with a rectangular base two nozzles 12*a*, into which box is introduced an air flow 12' from line 16 led through pressure nozzle parts 8. The working region of the suction port 6 is simultaneously affected by the vortex flow in the suction-nozzle tube 1 and by the shearing force of the flows resulting from the separate nozzles 12*a*, so that eventually particles or high-density gases attached to the surface are detached and, as they are already moving, are removed by a very slight suction effort.

The size of the flow-impacted surface 6" as well as its angle of incidence $\alpha$ are easily matched to the pressure and vortex condition to be obtained in the suction port, as the Coanda effect resulting from this configuration facilitates an optimal jet guidance. A sharp edge K serves in a per se known manner for the required change of direction of the jet.

For economic and aerodynamic reasons, the suction-nozzle tube 80 is designed to be integral with the plane surfaces 6", forming the suction-nozzle component 90.

Analogously, the nozzle can also be of a rotationally symmetrical design, whereby the same effect is achieved by a single nozzle 12*a*.

The gases drawn off the surface M to be treated, respectively the particles contained in the flow, are positively removed in direction of suction from the upper portion 6A of the suction port through connection lines 16A leading to per se known falters and/or separators 13 and/or condensers, catalysts, etc. Via a bypass 14 the flow exiting these devices can be recirculated, for instance via a connection to the pressure-nozzle components 8.

A suitable compressor, for instance a multi-stage axial or radial blower facilitates via its inlets and outlets a highly energy-saving operation of the nozzle, with optimum effect.

Figure 12:
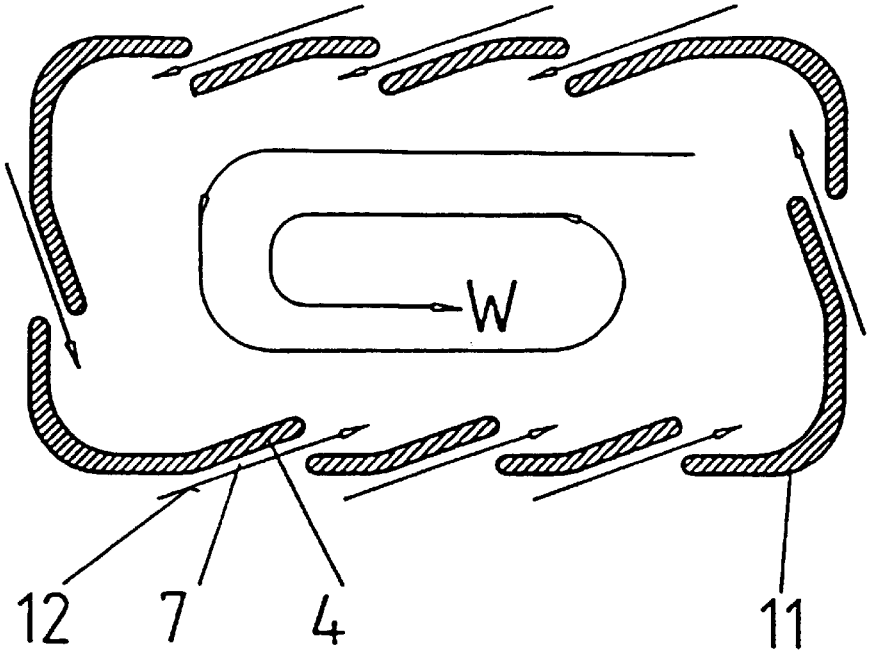
FIG. 12 is a partial view, in a schematic top view, of an arrangement analogous to FIG. 11, showing lateral wings for producing of a tangential, central flow.
Figure 13:
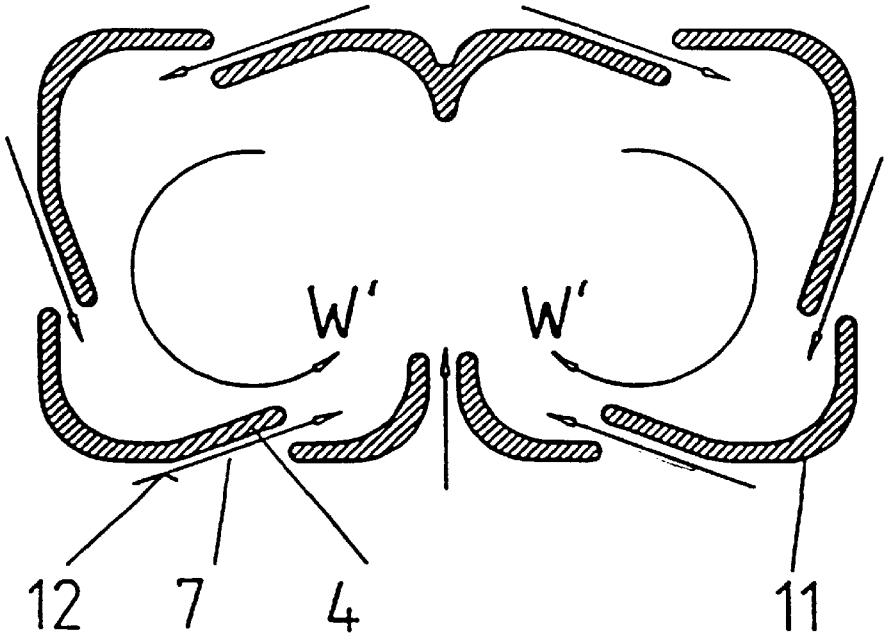
FIG. 13 shows a variant of FIG. 12 with two double vortices.

FIGS. 12 and 13 show in a top view possibilities of the development of the circular vortex flow W' respectively the double vortices W' in the nozzle. The entering flow, characterized by straight arrows, is again marked with numeral 12.

It is clear that two principles: shearing force due to the nozzles and shearing force due to the vortex flow, cooperate to great advantage.

This variant is, amongst others, meant for installation in already existing street sweeping machines and, in addition to a low energy consumption, is particularly characterized by low dust and noise generation; the blower 15 used can work in an almost closed air circuit, its space demands when built into the vehicles are modest and it can be optimally insulated acoustically.

Because of the low suction effort required, environmental load due to stirred-up dust and due to fine dust passing through the filters is minimal, as compared to known devices.

Experiments have given proof of the universal, applicability of the nozzle according to the invention. Particularly favorable results were achieved in the removal of silt in cooling water inlets of power stations. The advantageous use of the nozzle for the cleaning of sidewalks, streets and squares could also be shown.

I claim:

1. A suction nozzle, comprising a suction nozzle tube having a first end for connection to a suction line and a second end forming a suction port, and at least one lateral opening in the suction nozzle tube in a zone of the suction port for generating a further flow extending in a direction tangential to the suction flow wherein the at least one lateral opening is formed by at least one bent wing raised from the suction-nozzle tube.

2. The suction nozzle according to claim 1, wherein the suction nozzle tube includes a collar concentrically surrounding the suction port.

3. The suction nozzle according to claim 1, wherein the suction nozzle tube includes a sharp edge in the suction port.

4. The suction nozzle of claim 1, wherein at least one of the at least one bent wings is bent in an opposite sense to the other of the wings whereby tangential partial flows having oppositely rotating movement components are generated.

5. The suction nozzle according to claim 1, further comprising outer guide walls arranged in a box-like form surrounding and attached to the suction nozzle tube, a pressure nozzle component leading into the interior of the outer guide walls, the pressure-nozzle component splitting into two oppositely located nozzles extending into the working zone of the suction port.

6. The suction nozzle according to claim 5, wherein the outer guide walls include at least one lateral opening formed by at least one bent wing raised from the outer guide walls.

7. The suction nozzle of claim 1 further comprising means for generating a shearing force flow superimposed upon a vortex flow component in a working zone of the suction port.

8. The suction nozzle of claim 7, wherein said shearing force flow generating means comprises a pair of pressure nozzles located on opposite sides of the suction port.

* * * * *